US009726352B2

(12) United States Patent
Ahn

(10) Patent No.: US 9,726,352 B2
(45) Date of Patent: Aug. 8, 2017

(54) LAMP FOR VEHICLE HAVING A ROTATING REFLECTOR AND A REFLECTING BODY

(71) Applicant: HYUNDAI MOTOR COMPANY, Seoul (KR)

(72) Inventor: Byoung Suk Ahn, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 252 days.

(21) Appl. No.: 14/670,391

(22) Filed: Mar. 26, 2015

(65) Prior Publication Data

US 2016/0123559 A1 May 5, 2016

(30) Foreign Application Priority Data

Nov. 4, 2014 (KR) ..... 10-2014-0152268

(51) Int. Cl.

| | |
|---|---|
| ***F21S 8/10*** | (2006.01) |
| ***F21V 7/00*** | (2006.01) |
| ***F21V 14/04*** | (2006.01) |
| ***F21V 9/16*** | (2006.01) |
| ***F21V 7/10*** | (2006.01) |
| *F21Y 115/30* | (2016.01) |
| *F21Y 115/10* | (2016.01) |

(52) U.S. Cl.

CPC ..... *F21V 14/04* (2013.01); *F21S 48/00* (2013.01); *F21S 48/1154* (2013.01); *F21S 48/1305* (2013.01); *F21S 48/1388* (2013.01); *F21V 7/10* (2013.01); *F21V 9/16* (2013.01); *F21Y 2115/10* (2016.08); *F21Y 2115/30* (2016.08)

(58) Field of Classification Search

CPC ..... F21S 48/13; F21S 48/23; F21S 48/232; F21S 48/1757; F21S 48/1154; F21S 48/1305; F21S 48/1388; F21S 48/1752; F21V 14/04

USPC ..... 362/507, 475

See application file for complete search history.

(56) References Cited

U.S. PATENT DOCUMENTS

| | | | | |
|---|---|---|---|---|
| 2013/0215634 | A1 | 8/2013 | Tseng | |
| 2014/0177252 | A1* | 6/2014 | Lai | B60Q 1/085 362/514 |
| 2016/0123550 | A1* | 5/2016 | Ahn | F21S 48/1145 362/510 |

FOREIGN PATENT DOCUMENTS

| | | | |
|---|---|---|---|
| EP | 2623373 | A2 | 8/2013 |
| JP | 2009-163921 | A | 7/2009 |
| JP | 2011-243371 | A | 12/2011 |
| JP | 2012-054084 | A | 3/2012 |
| JP | 2012-089479 | A | 5/2012 |
| KR | 10-2003-0003971 | A | 1/2003 |
| KR | 10-0776745 | B1 | 11/2007 |

(Continued)

OTHER PUBLICATIONS

Korean Notice of Allowance dated Sep. 28, 2016 issued in Korean Patent Application No. 10-2014-0152268.

(Continued)

*Primary Examiner* — Karabi Guharay

(74) *Attorney, Agent, or Firm* — McDermott Will & Emery LLP

(57) ABSTRACT

A lamp for a vehicle includes a light source generating a light. A reflector is rotatably coupled with a support. A reflecting body is connected to the reflector to rotate along with a rotation of the reflector, receives the light from the light source, and reflects the light to the reflector.

18 Claims, 5 Drawing Sheets

(56) References Cited

FOREIGN PATENT DOCUMENTS

| | | | |
|---|---|---|---|
| KR | 10-2009-0088631 | A | 8/2009 |
| WO | 2014/119980 | A1 | 8/2014 |

OTHER PUBLICATIONS

Extended European Search Report dated Mar. 23, 2016 issued in European Patent Application No. 151607637.

* cited by examiner

LAMP FOR VEHICLE HAVING A ROTATING REFLECTOR AND A REFLECTING BODY

CROSS REFERENCE TO RELATED APPLICATION

The present application claims the benefit of priority to Korean Patent Application No. 10-2014-0152268, filed on Nov. 4, 2014, the entire contents of which is incorporated herein for all purposes by this reference.

TECHNICAL FIELD

The present disclosure relates to a lamp for a vehicle, and more particularly, to a lamp for a vehicle capable of adjusting a reflector independent of a light source.

BACKGROUND

A vehicle lamp includes a light source generating light and a reflector irradiating the light generated from the light source to a front side or back side of a vehicle.

A plurality of reflectors and light sources are installed in one vehicle at different locations. Thus, the reflectors and the light sources are generally installed in a fixedly coupled state as one module to increase installation easiness and production efficiency.

However, a typical method for fixedly coupling the light source with the reflector limits a design layout. That is, the light source includes a heat radiating fin which has a large size in order to spread heat of the light source, and therefore, the installation of the reflector and the light source is limited.

Further, since the reflector and the light source are fixedly and integrally coupled, the overall module needs to be replaced when any of the reflector and the light source is damaged, thus increasing cost.

The matters described as the related art have been provided only for assisting in the understanding for the background of the present disclosure and should not be considered as corresponding to the related art known to those skilled in the art.

SUMMARY

An aspect of the present inventive concept provides a lamp for a vehicle in which a reflector and a light source may be separately installed, and thus, the reflector may independently be implemented.

According to an exemplary embodiment of the present inventive concept, a lamp for a vehicle includes a light source generating a light. A reflector is rotatably coupled with a support. A reflecting body is connected to the reflector to rotate along with a rotation of the reflector, receives the light from the light source, and reflects the light to the reflector.

The reflector may be axis-coupled with the support and may rotate forward and backward based on an axis.

The support may be a lamp housing or a frame which is connected to a vehicle body or the lamp housing to support the reflector.

The light source may generate a laser beam.

The reflecting body may rotate at a set ratio with the reflector.

The reflecting body may be rotatably axis-coupled with the support forward and backward. The reflector and the reflecting body may have a set ratio and each be coupled with a reflector side gear and a reflecting body side gear which are meshed with each other.

The reflector and the reflecting body may each rotate while each having the rotation angle having a set ratio of 2:1.

The reflector may further have a phosphor which is provided on a moving path of light reflected from a reflection surface and the reflecting body, and may change a wavelength of the light incident from the reflecting body and irradiate the light to the reflection surface.

The reflector and the reflecting body may each be axis-coupled with the support, and the reflecting body may rotate depending on Equation $$\theta = \tan^{-1}\frac{a\sin\alpha}{b + a(1 - \cos\alpha)}$$

when the reflector rotates, where a represents a distance from a rotation axis of the reflector to a center of a light incident surface of the phosphor, b represents a distance from a rotation axis of the reflecting body to a center of the light incident surface of the phosphor, $\alpha$ represents an angle of rotation of the reflector, and $\theta$ represents an angle of rotation of the reflecting body.

The lamp for a vehicle may further include a subframe disposed between the reflector and the support to rotate the reflector forward and backward. Upper and lower ends of the reflector are each axis-coupled with the support such that the reflector rotates left and right. Axis protrusions, which are rotatably axis-coupled with the support, are formed at left and right ends and protrude outwardly.

A virtual line connecting from the upper and lower ends of the reflector to a point at which the upper and lower ends of the reflector are axis-coupled with the subframe may pass through a center of a light incident surface of the phosphor.

The reflector may be symmetrical based on the phosphor.

The reflecting body may have a front surface on which the light from the light source is incident and a rear side of the reflecting body may be covered by a cover part to prevent the light from the light source from being leaked to the outside.

The cover part may be an extending panel which has an end rotatably coupled with the subframe by allowing the reflector to extend downwardly from a phosphor side.

The lamp may further include a first control part having one end coupled with an upper end or a lower end of the reflector, and pushing or pulling the reflector forward and backward to rotate the reflector forward and backward. A second control part has one end coupled with a left side or a right side of the reflector and pushes or pulls the reflector forward and backward to rotate the reflector left and right.

Other ends of the first control part and the second control part may have threads, and the reflector may have nuts made of an elastic material which are coupled with the first control part or the second control part.

The light source and the reflector may be separated from each other.

BRIEF DESCRIPTION OF THE DRAWINGS

The above and other objects, features and advantages of the present disclosure will be more clearly understood from the following detailed description taken in conjunction with the accompanying drawings.

DETAILED DESCRIPTION

Hereinafter, a lamp for a vehicle according to an exemplary embodiment of the present inventive concept will be described with reference to the accompanying drawings.

Figure 1:
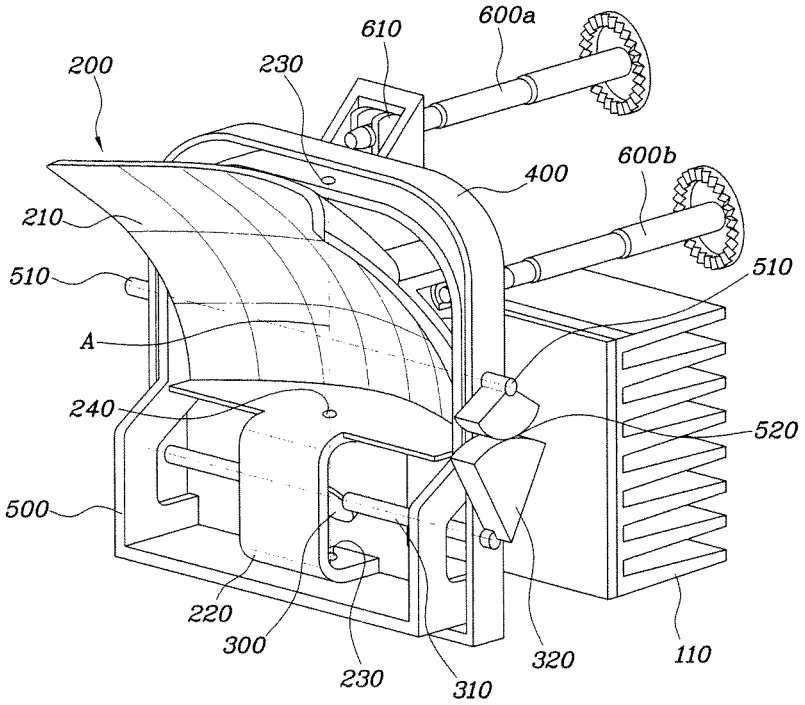
FIG. 1 is a perspective view of a lamp for a vehicle according to an exemplary embodiment of the present inventive concept.
Figure 2:
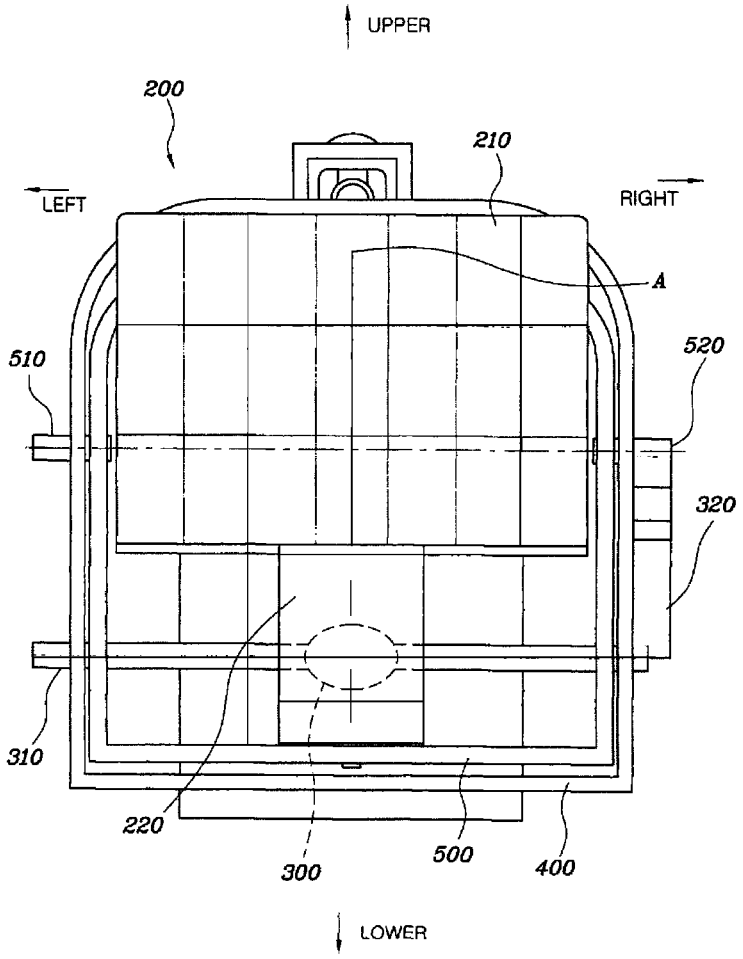
FIG. 2 is a front view of the lamp for a vehicle according to the exemplary embodiment of the present inventive concept.
Figure 3:
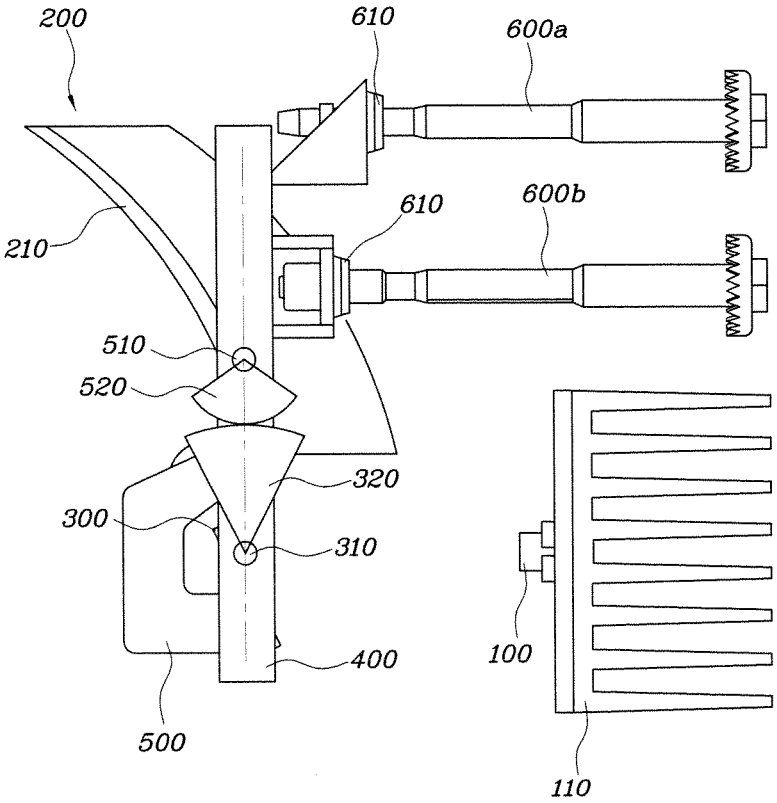
FIG. 3 is a side view of the lamp for a vehicle according to the exemplary embodiment of the present inventive concept.

FIG. 1 is a perspective view of a lamp for a vehicle according to an exemplary embodiment of the present inventive concept, FIG. 2 is a front view of the lamp for a vehicle according to the exemplary embodiment of the present inventive concept, and FIG. 3 is a side view of the lamp for a vehicle according to the exemplary embodiment of the present inventive concept.

Referring to FIGS. 1-3, the lamp for a vehicle according to the exemplary embodiment of the present inventive concept includes a light source 100 generating light. A reflector 200 is rotatably coupled with a support 400. A reflecting body 300, which is connected with the reflector 200 to rotate along with rotation of the reflector 200, receives the light from the light source 100 and reflects the light to the reflector 200.

In detail, the light source 100 may generate light going straight while being concentrated in a specific direction. A laser diode may be used to generate a laser beam. By using the laser diode, the light from the light source 100 may be reflected to the reflector 200 while being concentrated on the reflecting body 300, and a size of the reflecting body 300 may be compactly formed to increase freedom of layout and shape of the reflector 200.

However, the present disclosure is not limited to the laser diode, and therefore, various types of light emitting devices such as a light-emitting diode (LED) and a general bulb may be used. Various embodiments may be applied to the light source 100.

Further, the light source 100 may be coupled with a separate cooling fin 110 for cooling high heat generated from the light source 100. The light source 100 and the cooling fin 110 are separated from the reflector 200 as a separate module and may be independently provided. That is, the reflector 200 and the light source 100 may be installed not to be coupled with each other. Further, considering a designer's intention or a layout of a lamp housing, the reflector 200 and the light source 100 may be coupled with each other.

The support 400 may be a lamp housing or may be a frame which is connected to a vehicle body or the lamp housing to support the reflector 200.

In other words, the housing itself enclosing the lamp may also be the support 400 or may be a frame which is directly or indirectly coupled with the vehicle body or the lamp housing. Further, in addition to the foregoing embodiment, the support 400 may be various forms of support structures which may support the reflector 200 and the reflecting body 300.

The reflector 200 is axis-coupled with the support 400 and may rotate forward and backward based on an axis. Here, a front may be a direction in which the light from the reflector 200 is reflected and irradiated. Further, a left and right direction may be a bilateral direction of the reflector 200.

A subframe 500 may be further provided between the reflector 200 and the support 400 to rotate the reflector 200 forward and backward. Upper and lower ends of the reflector 200 are each axis-coupled with the support 400 so that the reflector 200 may rotate left and right, and axis protrusions 510 which are rotatably axis-coupled with the support 400 are formed at left and right ends of the support 400 to protrude outwardly.

That is, the subframe 500 may rotate forward and backward with respect to the support 400 based on the axis protrusion 510, and upper and lower ends of the subframe 500 are each axis-coupled with the upper and lower ends of the reflector 200, and thus, the reflector 200 may rotate left and right with respect to the subframe 500. Therefore, the axis coupling with the support 400 of the reflector 200 is performed via the subframe 500 and the rotation of the reflector 200 forward and backward is also performed via the subframe 500.

The upper and lower ends of the reflector 200 may be provided with protrusions 230 for axis rotation in a left and right direction, and the subframe 500 may be provided with a groove or a hole so as to insert the protrusions 230 thereinto. Here, the coupling may not be made by the groove or the hole, but the coupling may be made by a separate bearing. This may be identically applied to the coupling between the subframe 500 and the support 400.

In addition, the reflecting body 300 may be coupled with the support 400 by a protrusion or a bar-shaped coupling shaft 310 so as to axis-rotate forward and backward and may have various shapes such as a panel coated with a reflection material such as metal or a mirror which may reflect light.

The reflector 200 may further have a reflection surface 210 which reflects light and a phosphor 240 which is provided on a moving path of light reflected from the reflecting body 300 and changes a wavelength of light incident from the reflecting body 300 and irradiates the light to the reflection surface 210. In this case, when the laser beam of the light source 100 directly radiates, the laser beam may fatally injure a person and the laser beam itself may not function as a lamp, and therefore, the phosphor 240, which absorbs the wavelength of the laser beam and emits light of another wavelength, needs to be provided in the reflector 200.

Therefore, the phosphor 240 is disposed between the reflection surface 210 and the reflecting body 300, and thus emits light by the laser beam reflected from the reflecting body 300 and irradiates the emitted light in front of the reflector 200 by the reflection surface 210.

The phosphor 240 may be provided so that a virtual line A connecting from the upper and lower ends of the reflector 200 to a point at which the upper and lower ends of the reflector 200 are axis-coupled with the subframe 500 passes through a center of a light incident surface of the phosphor 240. Here, the center of the light incident surface may be a center of an area of the laser beam which is incident on the phosphor 240.

Since the phosphor 240 is provided on the same line as the virtual line A, even though the reflector 200 rotates left and right, the laser beam may be irradiated to the same point of the phosphor 240 at all times and may prevent the laser beam from being irradiated deviating from the phosphor 240 due to the rotation. Or the reflector 200 may have a symmetrical shape based on the phosphor 240. The protrusions 230, which are axis-coupled with the subframe 500 at the upper and lower ends of the reflector 200, may be disposed at the center in the left and right direction of the reflector 200 to be provided on the same line as the phosphor 240.

The reflecting body 300 has a front surface on which the light from the light source 100 is incident, and a rear of the reflecting body 300 may have a cover part 220 to prevent light from the light source 100 being leaked in back of the reflecting body 300. The cover part 220 may be an extending panel which extends downwardly from a circumferential portion of the phosphor 240 or the reflection surface 210 to allow the reflector 200 to cover the rear of the reflecting body 300, and thus has an end rotatably coupled with the subframe 500. According to the lamp for a vehicle as described above, a separate panel is not necessary, and therefore, a layout may be simplified. However it is not limited thereto that the cover part 220 may not extend from the reflector 200. The cover part 220 may use a separately provided panel or may have a different shape than the panel. Therefore, the cover part 220 may be variously established.

Figure 4:
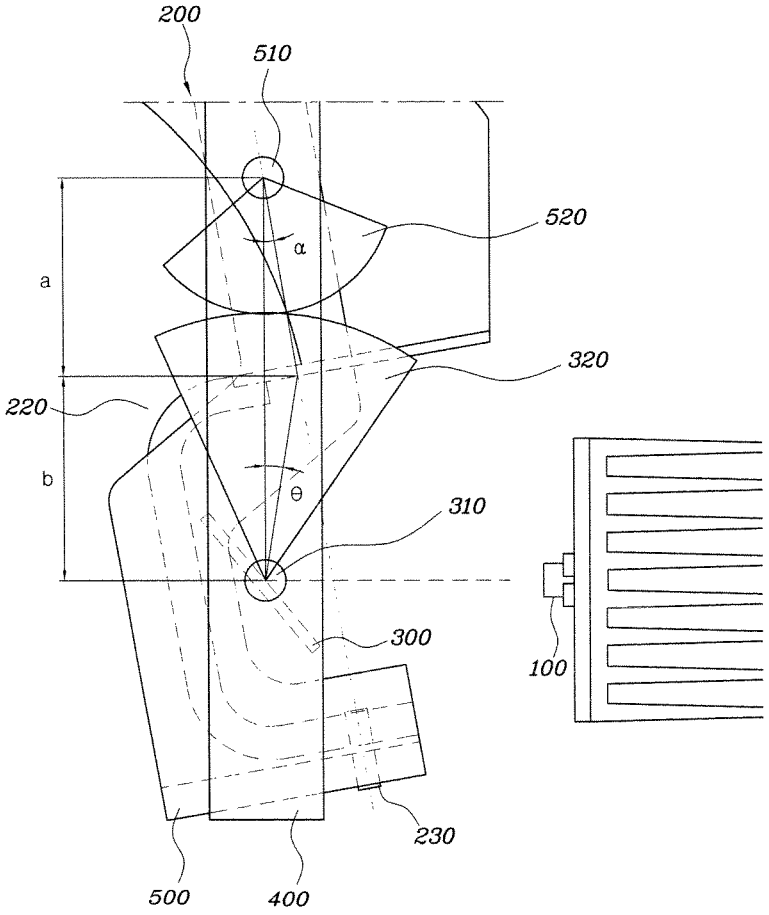
FIG. 4 is a view illustrating a rotation ratio between a reflector and a reflecting body.

FIG. 4 is a view illustrating a rotation ratio between the reflector and the reflecting body, in which the reflecting body 300 is connected with the reflector 200, and thus may rotate under a set ratio at the time of the rotation of the reflector 200.

In detail, the reflecting body 300 is axis-coupled with the support 400 under the phosphor 240 to rotate forward and backward so as to reflect the light from the light source to the phosphor 240.

The reflector 200 and the reflecting body 300 may each be coupled with the reflector side gear 520 and the reflecting body side gear 320 which are meshed with each other, while having the set ratio.

A reflector side gear 520 and a reflecting body side gear 320 may rotate along with the reflector 200 or the reflecting body 300, each of which is coupled with the axis protrusion 510 of the subframe 500 and the coupling shaft 310 of the reflecting body 300.

According to the exemplary embodiment of the present inventive concept, the reflection surface 210 of the reflector 200 is provided above the reflecting body 300, and thus, the reflector side gear 520 is provided above the reflecting body side gear 320, which may be variously changed according to the layout of the reflector 200 and the reflecting body 300 or the designer's intention.

Further, the exemplary embodiment of the present inventive concept describes that the reflector side gear 520 and the reflecting body side gear 320 are gear-toothed with each other, but may rotate together while friction-contacting each other, not being gear-toothed with each other or may be set to transmit a power through a connection means such as a belt and a chain.

When the reflecting body 300 rotates depending on Equation $$\theta = \tan^{-1}\frac{a\sin\alpha}{b + a(1 - \cos\alpha)}$$

at the time of the rotation of the reflector 200, the reflecting body 300 may reflect the light from the light source 100 toward the phosphor 240 at all times independent of an angle of rotation of the reflector 200 (a represents a distance from the center of a rotation axis of the reflector 200 to the center of the light incident surface of the phosphor 240, b represents a distance from the center of the rotation axis of the reflecting body 300 to the center of the light incident surface of the phosphor, $\alpha$ represents the angle of rotation of the reflector, and $\theta$ represents the angle of rotation of the reflecting body). It may be appreciated from a graph depending on the above Equation that a linear relationship of $\theta=2\alpha$ is formed within the angle of rotation of the reflector 200 of about 5°. Therefore, a gear ratio of the reflector side gear 520 and the reflecting body side gear 320 may be set such that the reflector 200 and the reflecting body 300 rotate at the rotational angle having a set ratio of 2:1. Further, when the rotational angle of the reflector 200 is more than 5°, a gear tooth of each gear may be set depending on the above Equation, and even though the rotational angle of the reflector 200 is set to be about 5°, the gear ratio is not necessarily set to be 2:1 but the gear ratio may be set depending on the above Equation.

Figure 5:
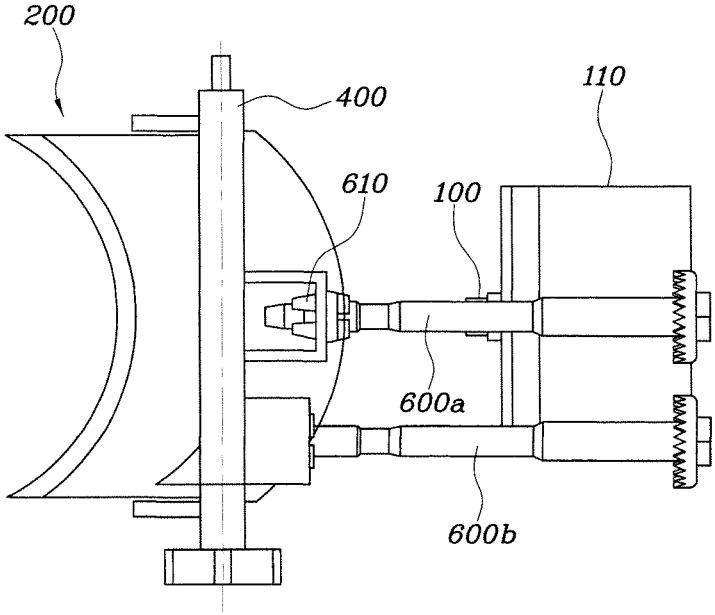
FIG. 5 is a top side view of the lamp for a vehicle according to the exemplary embodiment of the present inventive concept.

FIG. 5 is a top side view of the lamp for a vehicle according to the exemplary embodiment of the present inventive concept. As shown in the figure, the lamp for a vehicle may further comprise a first control part 600*a* having one end coupled with an upper end or a lower end of the reflector 200 or the subframe 500 and pushing or pulling the reflector 200 forward and backward to rotate the reflector 200 forward and backward. A second control part 600*b* having one end coupled with a left side or right side of the reflector 200 pushes or pulls the reflector 200 forward and backward to rotate the reflector 200 left and right.

Other ends of each of the first control part 600*a* and the second control part 600*b* has threads, and the reflector 200 may have nuts 610 coupled with the first control part 600*a* or the second control part 600*b*.

The first control part 600*a* and the second control part 600*b* may have the ends coupled with the nut 610 in a bar shape and the shape of the first control part 600*a* and the second control part 600*b* may be variously set. Since the first control part 600*a* and the second control part 600*b* are biasedly provided at the upper and lower and the left and right of the reflector 200, the first control part 600*a* or the second control part 600*b* rotates, and thus, the reflector 200 may rotate by bolt-nut coupling.

Further, the nut 610 is made of an elastic material, and thus may manage bending or a change in a length of the second control part 600*b* which occurs when the reflector 200 rotates forward and backward or bending or a change in a length of the first control part 600*a* which occurs when the reflector 200 rotates horizontally, such that controlling of the reflector 200 for an accurate light aim without a complex configuration may be achieved.

In addition, the foregoing first control part 600*a* and second control part 600*b* are not limited to the above example but may be variously implemented, and therefore, the first and second control parts 600*a* and 600*b* may have a cylinder form so as to have a varying length or the first and second control parts 600*a* and 600*b* may have a length varying by a rotation of a motor in which an eccentric cam is installed, or the first and second control parts 600*a* and 600*b* may allow the motor to directly rotate the reflector 200 forward and backward or horizontally without a change in length.

According to the lamp for a vehicle having the above structure, even though the light source and the reflector are separated from each other, the light from the light source reaches a predetermined position at all times, thereby enabling the reflector to perform the independent aiming.

The light source and the reflector are independently separated from each other, thereby increasing the freedom of shape of the reflector and the layout at the time of installation.

Even though any one of the reflector and the light source has a problem, the reflector and the light source may be separately replaced and repaired, thereby saving costs.

Further, the reflector may be independently adjusted to increase a fluctuation width and implement an irradiation angle having various forms and an irradiation shape.

Although the present inventive concept has been shown and described with respect to specific exemplary embodiments, it will be obvious to those skilled in the art that the present disclosure may be variously modified and altered without departing from the spirit and scope of the present disclosure as defined by the following claims.

What is claimed is:

1. A lamp for a vehicle, comprising:

a light source generating a light;

a reflector rotatably coupled with a support; and a reflecting body connected to the reflector to rotate along with rotation of the reflector, the reflecting body receiving the light from the light source and reflecting the light to the reflector, wherein the reflector is axis-coupled with the support and rotates forward and backward based on an axis, and wherein the reflecting body is rotatably axis-coupled with the support forward and backward, and the reflector and the reflecting body each having a set ratio are coupled with a reflector side gear and a reflecting body side gear which are meshed with each other.

2. The lamp of claim 1, wherein the support is a lamp housing or a frame connected to a vehicle body or the lamp housing to support the reflector.

3. The lamp of claim 1, wherein the light source generates a laser beam.

4. The lamp of claim 3, wherein the reflector further includes a phosphor provided on a moving path of the light reflected from a reflection surface and the reflecting body, changing a wavelength of the light incident from the reflecting body, and irradiating the light to the reflection surface.

5. The lamp of claim 4, further comprising a subframe disposed between the reflector and the support to rotate the reflector forward and backward, wherein upper and lower ends of the reflector are each axis-coupled with the support such that the reflector rotates to left and right, and axis protrusions which are rotatably axis-coupled with the support are formed at left and right ends and protrude to outside.

6. The lamp of claim 5, wherein a virtual line connecting from the upper and lower ends of the reflector to a point at which the upper and lower ends of the reflector are axis-coupled with the subframe passes through a center of a light incident surface of the phosphor.

7. The lamp of claim 5, wherein the reflecting body has a front surface on which the light from the light source is incident and a rear side of the reflecting body is covered by a cover part to prevent the light from the light source from being leaked to the outside.

8. The lamp of claim 7, wherein the cover part is an extending panel which has an end rotatably coupled with the subframe by allowing the reflector to extend downwardly from a phosphor side.

9. The lamp of claim 5, further comprising:

a first control part having one end coupled with the upper end or the lower end of the reflector and pushing or pulling the reflector forward and backward to rotate the reflector forward and backward; and a second control part having an end coupled with a left side or a right side of the reflector and pushing or pulling the reflector forward and backward to rotate the reflector left and right.

10. The lamp of claim 9, wherein the ends of the first control part and the second control part have threads, and the reflector is provided with nuts made of an elastic material which are coupled with the first control part or the second control part.

11. The lamp of claim 5, wherein the upper and lower ends of the reflector have protrusions for axis rotation in a left and right direction, and the subframe has a groove or a hole to insert the protrusions thereinto.

12. The lamp of claim 4, wherein the reflector has symmetrical form based on the phosphor.

13. The lamp of claim 1, wherein the reflecting body and the reflector rotate at the set ratio.

14. The lamp of claim 13, wherein the reflector and the reflecting body rotate at a different angle of rotation with the set ratio of 2:1.

15. The lamp of claim 13, wherein each of the reflector and the reflecting body is axis-coupled with the support, and the reflecting body rotates at an angle calculated from Equation $$\theta = \tan^{-1}\frac{a\sin\alpha}{b + a(1 - \cos\alpha)}$$

when the reflector rotates, wherein a represents a distance from a rotation axis of the reflector to a center of a light incident surface of the phosphor, b represents a distance from a rotation axis of the reflecting body to the center of the light incident surface of the phosphor, $\alpha$ represents an angle of rotation of the reflector, and $\theta$ represents an angle of rotation of the reflecting body.

16. The lamp of claim 1, wherein the light source and the reflector are separated from each other.

17. The lamp of claim 1, wherein the reflecting body is coupled with the support by a protrusion or a bar-shaped coupling shaft to axis-rotate forward and backward.

18. The lamp of claim 1, wherein the light source is coupled with a separate cooling fin for cooling high heat generated from the light source.

* * * * *